US007100517B1

(12) United States Patent
Godwin

(10) Patent No.: US 7,100,517 B1
(45) Date of Patent: Sep. 5, 2006

(54) ERGONOMIC COMPUTER WORK STATION

(76) Inventor: Gary S. Godwin, 5609 S. Madison Pl., Tulsa, OK (US) 74105

( * ) Notice: Subject to any disclaimer, the term of this patent is extended or adjusted under 35 U.S.C. 154(b) by 237 days.

(21) Appl. No.: 10/671,342

(22) Filed: Sep. 25, 2003

(51) Int. Cl.
*A47B 37/00* (2006.01)
*A47B 9/02* (2006.01)
*A47B 21/00* (2006.01)
*A47B 21/04* (2006.01)

(52) U.S. Cl. ..... 108/50.01; 108/2; 108/37

(58) Field of Classification Search ..... 108/6, 108/8, 50.01, 50.02, 92, 96, 147.19, 147.21, 108/1–10, 37; 312/223.3, 319.4; 297/170, 297/217.1, 188.2, 188.01; 135/67
See application file for complete search history.

(56) References Cited

U.S. PATENT DOCUMENTS 672,303 A * 4/1901 Williams ..... 248/652
2,299,910 A * 10/1942 Linderme ..... 108/141
2,846,761 A * 8/1958 Evans ..... 269/84
3,022,898 A 2/1962 Loeb ..... 211/64
3,225,656 A 12/1965 Flaherty et al. ..... 89/37
4,077,333 A * 3/1978 Ballas ..... 108/6
4,099,469 A * 7/1978 Sahli ..... 108/1
4,392,486 A * 7/1983 Gardineer et al. ..... 606/242
4,566,732 A * 1/1986 Ostergaard et al. ..... 297/174 R
4,575,964 A 3/1986 Griffin ..... 42/94
4,779,884 A * 10/1988 Minati ..... 280/304.1
4,824,086 A 4/1989 Rickling et al. ..... 269/156
4,848,710 A 7/1989 Newman ..... 248/129
4,854,066 A 8/1989 Canterbury, Sr. ..... 42/94
4,880,270 A 11/1989 Cooper ..... 297/188
4,913,391 A 4/1990 Klipp ..... 248/214
D310,302 S 9/1990 Southard ..... D6/552
D313,886 S 1/1991 Southard ..... D6/552
5,027,989 A * 7/1991 Nevius ..... 223/120
5,056,864 A 10/1991 Cooper ..... 297/188
5,368,377 A 11/1994 Baines ..... 312/27
5,419,525 A 5/1995 Hilton ..... 248/371
5,483,898 A 1/1996 Seidl ..... 108/3
5,630,566 A 5/1997 Case ..... 248/122.1
5,671,091 A * 9/1997 Monroe et al. ..... 359/635
5,779,305 A 7/1998 Hocking ..... 297/217.4
5,798,517 A 8/1998 Berger ..... 250/203.4
5,930,933 A 8/1999 Schleicher ..... 42/94
5,967,599 A 10/1999 Cauffiel ..... 297/135
6,027,093 A * 2/2000 Reiher ..... 248/451
6,102,476 A 8/2000 May et al. ..... 297/217.3
6,269,753 B1 * 8/2001 Roddan ..... 108/50.01
6,286,794 B1 9/2001 Harbin ..... 248/123.2
6,298,794 B1 * 10/2001 Brown et al. ..... 108/50.01

(Continued)

*Primary Examiner*—Janet M. Wilkens
*Assistant Examiner*—Timothy Ayres
(74) *Attorney, Agent, or Firm*—Fellers, Snider, Blankenship, Bailey & Tippens, P.C.

(57) ABSTRACT

An ergonomic work station for computer components or for other purposes that is especially adapted for use by an individual having decreased mobility due to back pain or other conditions. The work station includes a base that extends beneath a chair or bed. A support arm has counter weight on a first side of a pivotal mount and a work table on a second side of the pivotal mount. The support arm may be pivoted to place the table in a work position in front of a user or in vertical position to permit unobstructed egress from or ingress to the chair or bed. The counter weight allows for the support arm to be easily pivoted from the work position to the vertical position by application of only very light pressure.

15 Claims, 9 Drawing Sheets

U.S. PATENT DOCUMENTS 6,425,631 B1 7/2002 Lin ..... 297/173
6,702,373 B1 * 3/2004 Rossko ..... 297/173
6,712,008 B1 * 3/2004 Habenicht et al. ..... 108/96
2002/0017595 A1 2/2002 Koyanagi ..... 248/122.1
2004/0025754 A1 * 2/2004 Dye ..... 108/50.01
2004/0163574 A1 * 8/2004 Schoenbach et al. .... 108/50.01

* cited by examiner

ERGONOMIC COMPUTER WORK STATION

FIELD OF THE INVENTION

This invention relates generally to an ergonomic work station. More particularly, the invention relates to a work station specially adapted for ease of use by an individual bothered by back pain.

BACKGROUND OF THE INVENTION

Many occupations require a worker to spend long periods of time in front of a computer screen. Problems associated with repetitive motion injuries due to computer keyboard or mouse manipulation may result in injuries to a computer user. A well known injury associated with repetitive motion is carpal tunnel syndrome. Injuries and discomfort may be minimized by proper positioning of a user with respect to a work object. Ergonomic designs for chairs and work stations have attempted to address these problems.

For an individual who experiences back pain, however, the simple act of sitting upright for long periods of time may result in debilitating discomfort. Further, the simple act of entering or exiting from a typical computer work station requires that a user bend his or her body in ways that may be uncomfortable or impossible for an individual experiencing back pain.

Some inventors have attempted to address the needs of individuals who, for whatever reason, are unable to sit in front of a computer. For example, U.S. Pat. No. 4,848,710 to Newman teaches a "Support Device" wherein a personal computer may be used by a person lying on a bed. The support body can be mounted on the bed itself, or on a base running on wheels beneath the bed.

Another example is U.S. Pat. No. 5,630,566 to Case for a "Portable Ergonomic Work Station". Case teaches a portable workstation that includes a variety of adjustable support elements that may hold and support computer components.

U.S. Pat. No. 6,286,794 to Harbin for an "Ergonomic Computer Mounting Device Permitting Extensive Vertical, Horizontal and Angular Ranges of Motion" teaches a column having a tilt and swivel mechanism for mounting a computer monitor thereon. The tilt and swivel mechanism is slidably mounted in a vertical track and a counterweight is provided to assist in vertical adjustment.

Other inventors have attempted to design systems for use with a chair or recliner. For example, U.S. Pat. Nos. 4,880,270 and 5,056,864 to Cooper for a "Work Station System" includes a chair having a carriage secured thereto. A surface for supporting an input device and a keyboard are attached to the carriage. The chair is rockable about a horizontal axis, but the spatial distance between the surface for supporting an input device and the seated operator remain constant, as does the spatial distance between the surface for supporting the visual display and the seated operator.

U.S. Pat. No. 5,779,305 to Hocking teaches "Work Stations" having a chair and a means to support pieces of equipment such as a personal computer, a printer and the like. The station has at least two upright stanchions that project upwardly in a substantially parallel manner from a base. Sleeves are engaged on the stanchions. Support members for the pieces of equipment are attached individually or in combination to a sleeve or sleeves so the support members will extend from the sleeves in a direction substantially normal to the longitudinal axis of the stanchions.

U.S. Pat. No. 5,967,599 to Cauffiel for a "Cabinet and Table Assembly for Use with Seating Apparatus" teaches a table that can slide between extended and retracted positions relative to a chair and may also be horizontally pivoted between a working position and an out-of-the-way position.

U.S. Pat. No. 6,102,476 to May et al. for a "Computer Furniture with Integrated Computer" teaches a chair with a monitor support and a keyboard support mounted on a horizontal arm that is pivotally attached to the left armrest.

U.S. Pat. No. 6,425,631 to Lin teaches a "Computer Chair Assembly" having a chair with two armrests, wherein a pivot shaft is disposed on one of the armrests. A horizontal rod is supported on one end by the pivot shaft and on a second end by rollers and a support. The horizontal rod supports an article support frame that may be pivoted in front of or away from a user seated in the chair.

None of the above references are ideal for use by an individual experiencing severe back pain. For example, none of the references teach a vertically pivoting member that permits a user to easily access a bed or chair wherein the pivoting member may be manipulated with fingertip pressure due to counter-weighting of the pivoting member. Additionally, it is desirable for a work station system to provide the above benefits in combination with structure that is adjustable in multiple ways to locate work pieces in an ergonomic orientation with respect to a user.

SUMMARY OF THE INVENTION

According to the present invention there is provided an improvement in an ergonomic computer workstation. The work station of the invention includes a base that extends beneath a human support device such as a chair, bed, or other structure. The base is preferably adjustable in length to accommodate human support devices of different widths. A riser extends upwardly from the base. A support arm pivotally connects to the riser and is stabilized by a support affixed to the riser and/or a support located at a distal end of the support arm. Preferably, both the riser and the supports are adjustable with respect to height for positioning a table at a desired height in front of a user. The support arm has a first section on a first side of the riser and a second section on a second side of the riser. The table is affixed to the second section of the support arm.

By pivoting the support arm, the table may be placed in a work position in front of a user or in a second position that removes the support arm and table as an encumbrance to egress from or ingress to the human support device. Preferably, the second position of the support arm is substantially vertical. A counter weight is affixed to the first section of the support arm. The counter weight allows for the support arm to be easily pivoted from the work position to the second position by application of only finger pressure. The table defines a plurality of retaining members for affixing selected computer components or other devices to the table, such that the devices do not move or fall off when the support arm and table are pivoted from a horizontal orientation to a non-horizontal or vertical orientation.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 5:
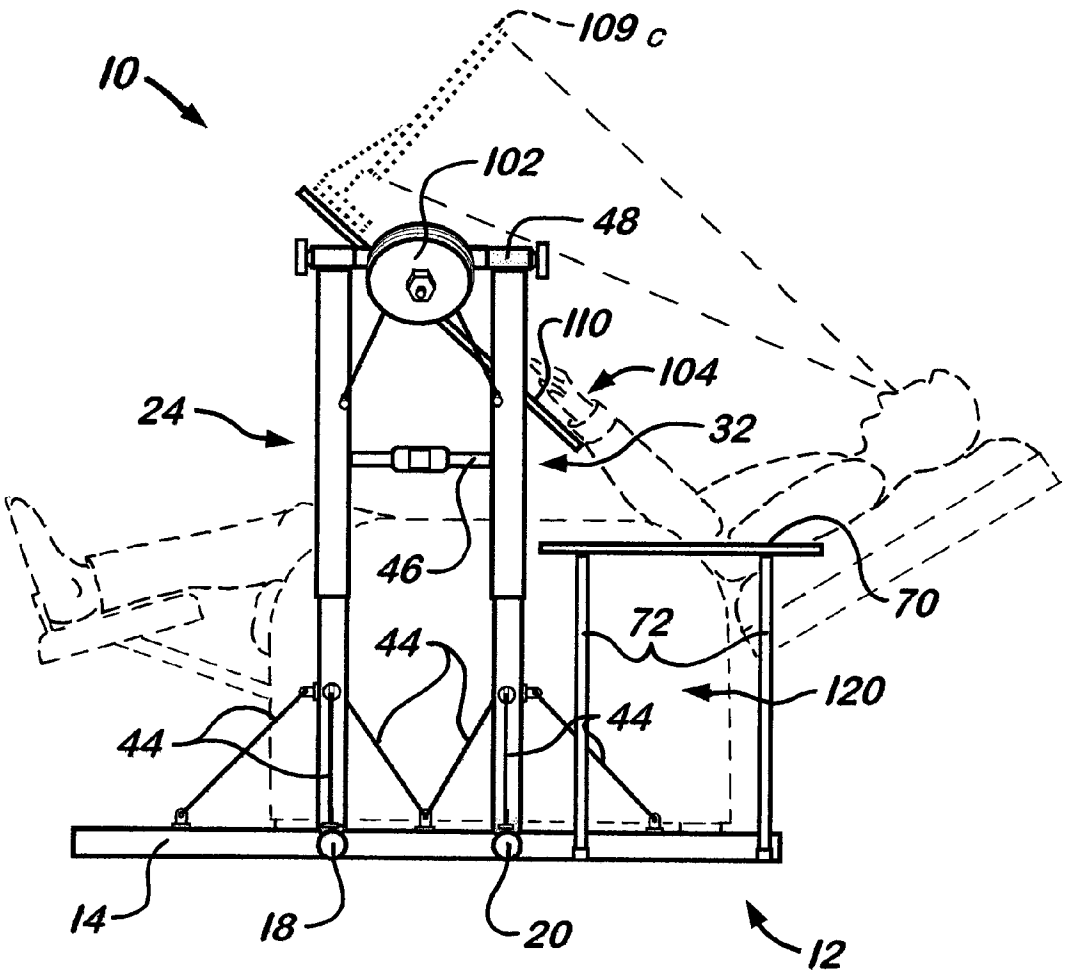
FIG. 5 is a side elevational view of a work station of the invention shown positioned adjacent a chair and showing a position of a user.
Figure 6:
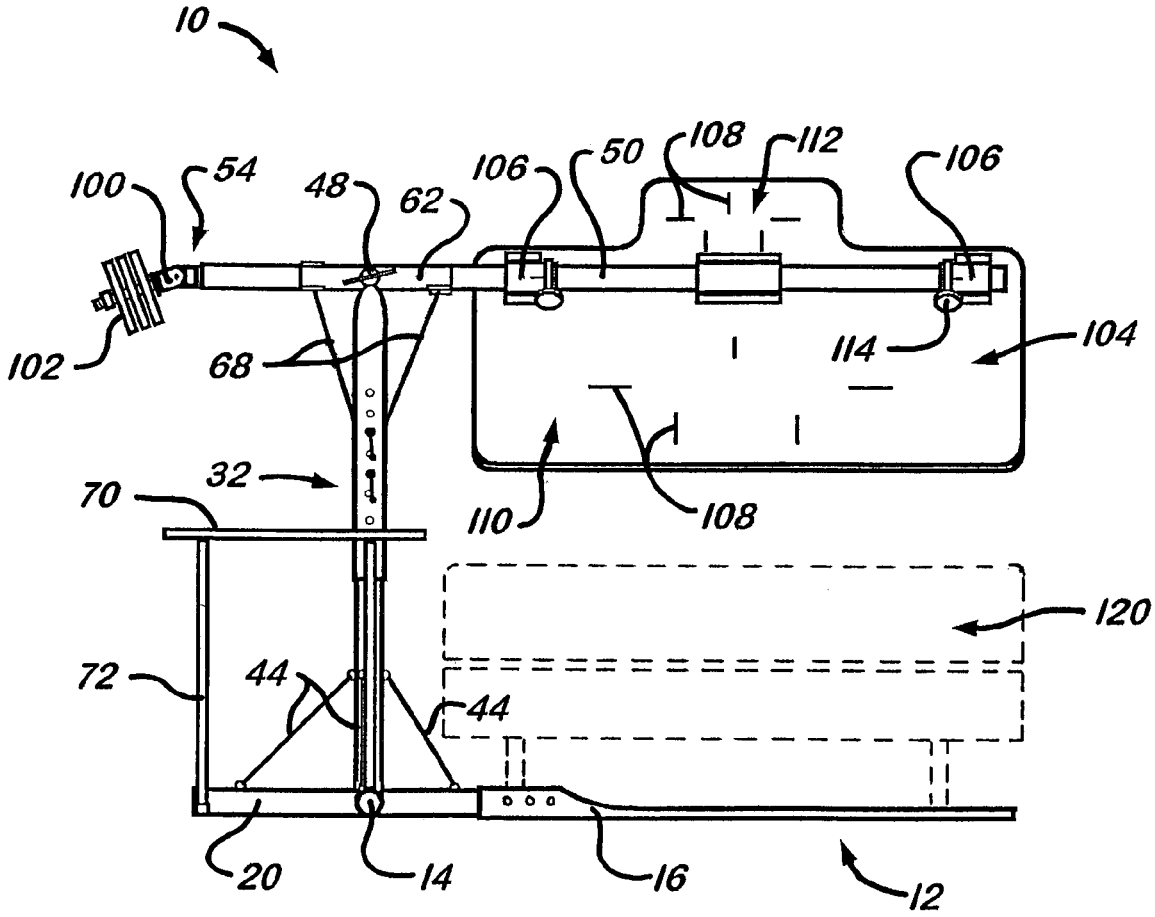
FIG. 6 is a front elevational view of a work station of another embodiment of the work station of the invention.
Figure 8A:
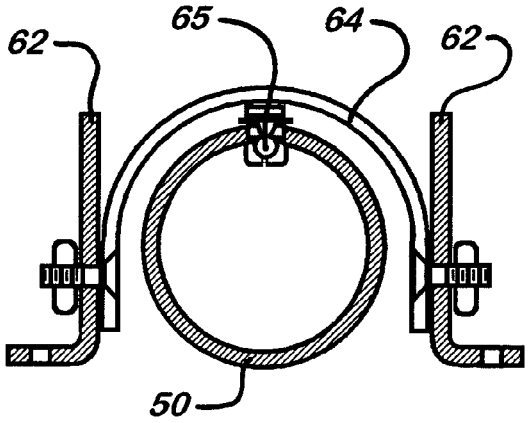
FIG. 8*a* is a cross-sectional view taken along line 8—8 of FIG. 7.
Figure 9A:
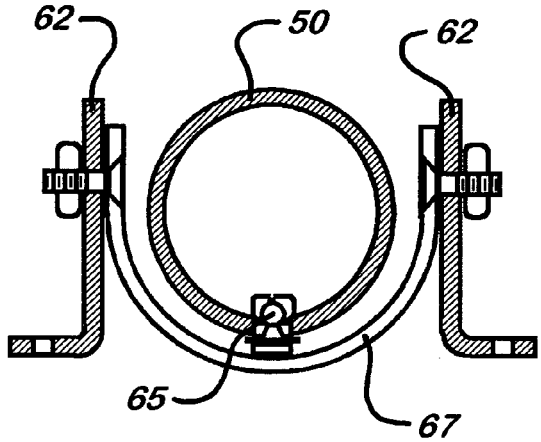
FIG. 9*a* is a cross-sectional view taken along line 9—9 of FIG. 7.
Figure 8B:
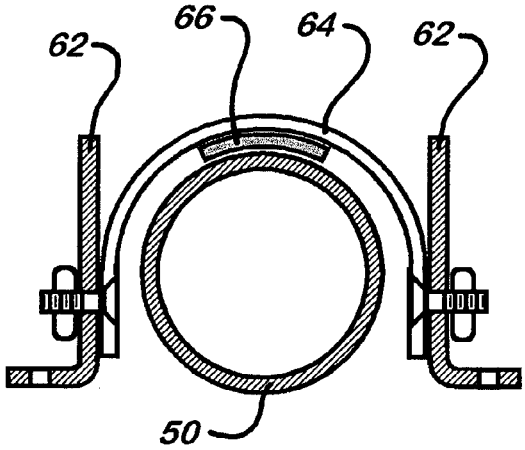
FIG. 8*b* is a cross-sectional view taken along line 8—8 of FIG. 7.
Figure 9B:
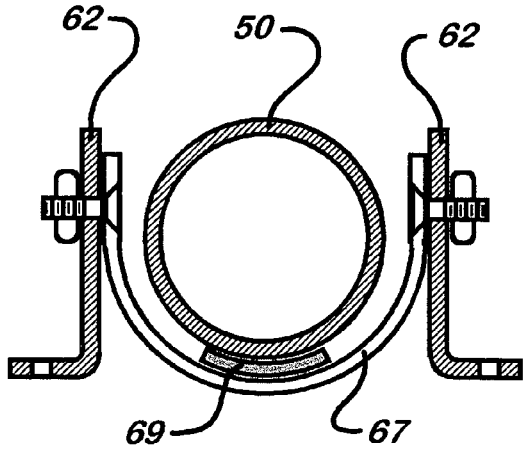
FIG. 9*b* is a cross-sectional view taken along line 9—9 of FIG. 7.

Referring now to FIGS. 1–6, shown is a work station 10. Work station 10 has a base 12. Base 12 has a first stabilizing member 14 and a cross member 16. Cross member 16 is preferably adjustable in length to accommodate different sizes of chairs, beds or other human support devices. Cross member 16 may span between components of work station 10 (FIG. 1), or cross-member 16 may adjustably extend from a single set of components (FIG. 6). A first extension member 18 extends from the first stabilizing member 14. A second extension member 20 also extends from first stabilizing member 14. Base 12 may additionally include a second stabilizing member 22.

Figure 10:
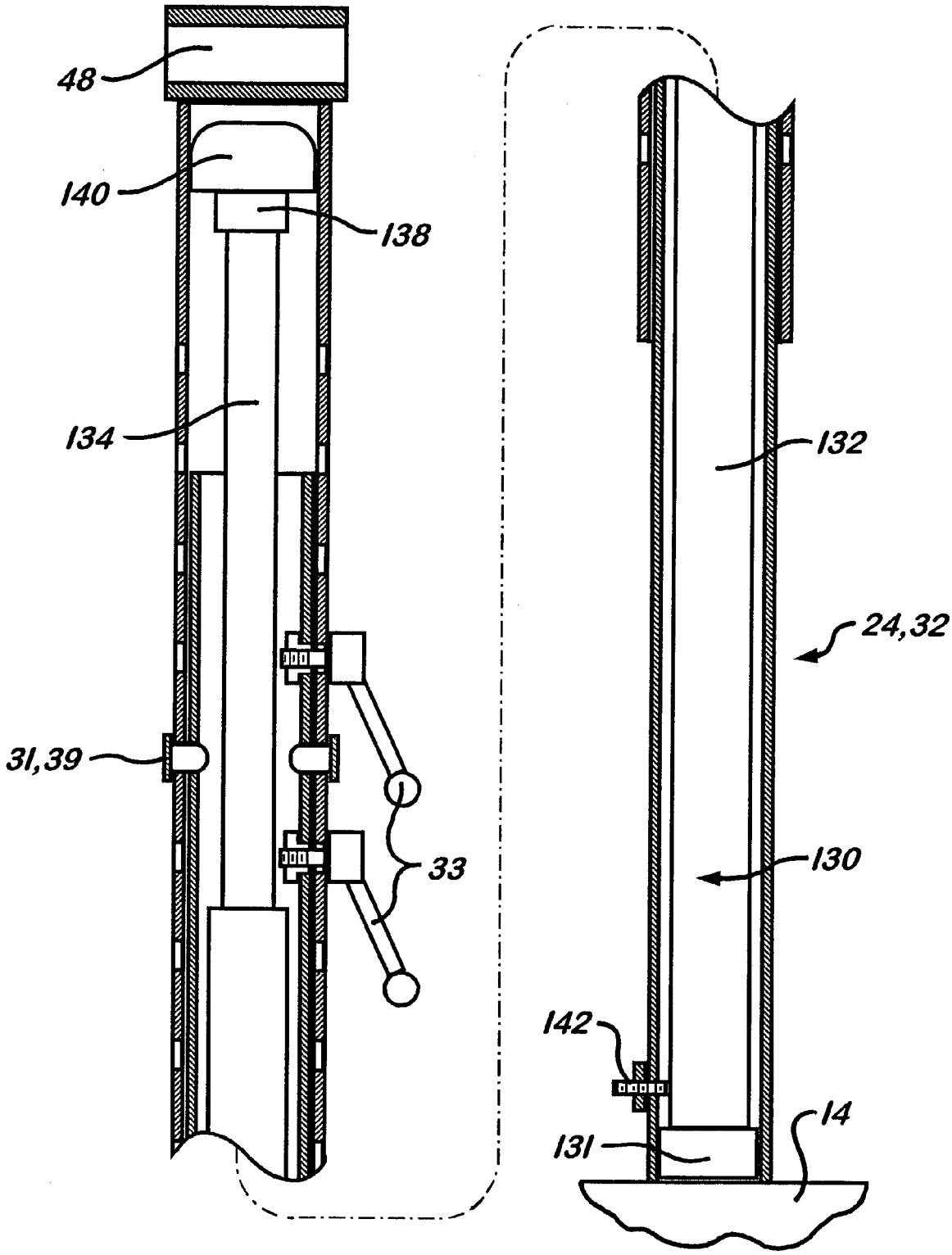
FIG. 10 is a partial cross-sectional view showing a riser of a workstation of the invention, taken along lines 10—10 of FIG. 2 and showing an enclosed pneumatic lift cylinder.

A first riser 24 extends vertically from first stabilizing member 14. First riser has a first sleeve member 26 telescopically received on a first vertical base piece 28. First sleeve member 26 defines a plurality of orifices 30 for affixing the first sleeve member 26 at a desired height, by means of a guide pin 31 (FIG. 10), securing devices 33 (FIGS. 3 & 10), both, or other securing devices.

A second riser 32 extends vertically from first stabilizing member 14. Second riser 32 has a second sleeve member 34 telescopically received on second vertical base piece 36. Second sleeve member 34 defines a plurality of orifices 38 for affixing second sleeve member 34 at a desired height by means of a guide pin 39 (FIG. 10), securing devices 33 (FIGS. 3 & 10), both, or other securing devices.

Referring back to FIG. 1, a first brace member 40 is affixed to first extension member 18 and first vertical base piece 28 for stabilizing first riser 24. A second brace member 42 is affixed to second extension member 20 and second vertical base piece 36 for stabilizing second riser 32. In an alternate embodiment, first brace member 40 and second brace member 42 are replaced with a plurality of tension members 44 (FIGS. 5 & 6). Preferably, tension members 44, which may be metallic cables, bicycle spoke-type rods or other members, extend between first stabilizing member 14 and first vertical base piece 28, first stabilizing member 14 and second vertical base piece 36, first extension member 18 and first vertical base piece 28, second extension member 20 and second vertical base piece 32, cross member 16 and first vertical base piece 28, and cross member 16 and second vertical base piece 36.

A cross-support 46 spans between first riser 24 and second riser 32. A pivot member 48 also spans between first riser 24 and second riser 32. A support arm 50 is pivotally affixed to pivot member 48. Support arm 50 has a first section 52 that terminates in a first end 54 on first side of risers 24 and 32. Support arm 50 has a second section 56 terminating in a second end 58 on the second side of risers 24 and 32. Preferably, cross-support 46 has a recessed portion for receiving first section 52 of support arm 50 when support arm 50 is in an upright position. A support arm cradle 60 is affixed to first sleeve member 26 and second sleeve member 34 of first riser 24 and second riser 32. First pivot member cradle 60 is provided to maintain support arm 50 in a horizontal or work position.

Figure 7:
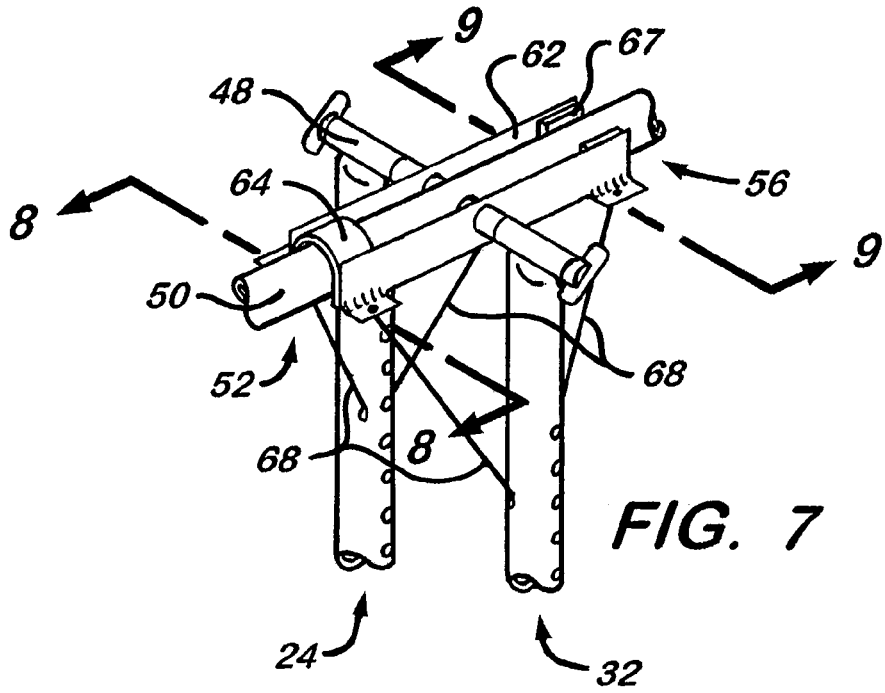
FIG. 7 is an enlarged perspective view of a pivot arm support of FIG. 6.

In another embodiment, shown in FIGS. 6–9*d*, a support arm sleeve 62 is provided that has a first inverted segment 64 for contacting first section 52 of pivot arm 50. First inverted segment 64 may be provided with a securing device for maintaining support arm 50 in contact with first inverted segment 64, i.e., in a horizontal or working position. Examples of securing devices include a protuberance and mating orifice 65 (FIG. 8*a*) and magnet 66 (FIG. 8*b*) for attracting support arm 50. Support arm sleeve 62 is additionally provided with a second segment 67 for contacting second section 56 of support arm 50. Second segment 67 may also be provided with a securing device for maintaining support arm 50 in contact with second segment 67, i.e., maintaining support arm 50 in a horizontal or working position. Examples of securing devices include a protuberance and mating orifice 65 (FIG. 9*a*) and magnet 69 (FIG. 9*b*) for attracting support arm 50. As shown in FIGS. 6 and 7, tension members 68 may be provided from the support arm sleeve 62 to first and second sleeve members 26, 34 of risers 24, 32.

Referring back to FIG. 1, a first shelf 70 is preferably provided. First shelf 70 may be used to support a computer CPU and/or a printer or other device. First shelf 70 has a free pair of shelf supports 72 and an attached pair of shelf supports 74. Attached pair of shelf supports 74 are preferably affixed to the first stabilizing member 14. Shelf 70 and supports 72 and 74 can be mounted on either end of first stabilizing member 14.

A second shelf 76 is preferably also provided. Second shelf 76 may be used as a work stand to hold a computer CPU/printer, papers or other materials. Second shelf 76 preferably has a free shelf support 78 and a pair of attached shelf supports 80. Attached shelf supports 80 are preferably affixed to second stabilizing member 22. Second shelf 76 is additionally supported by cradle stand 82. Shelf 70 can be reversed on shelf supports 80 and 82 with free shelf support 78 attaching to shelf 70 on the opposite side of cross member 16 and second stabilizing member 22. By permitting first shelf 70 and second shelf 76 to be located on either side of cross member 16, a user has greater flexibility to set-up the workstation in a desired configuration.

Figure 1:
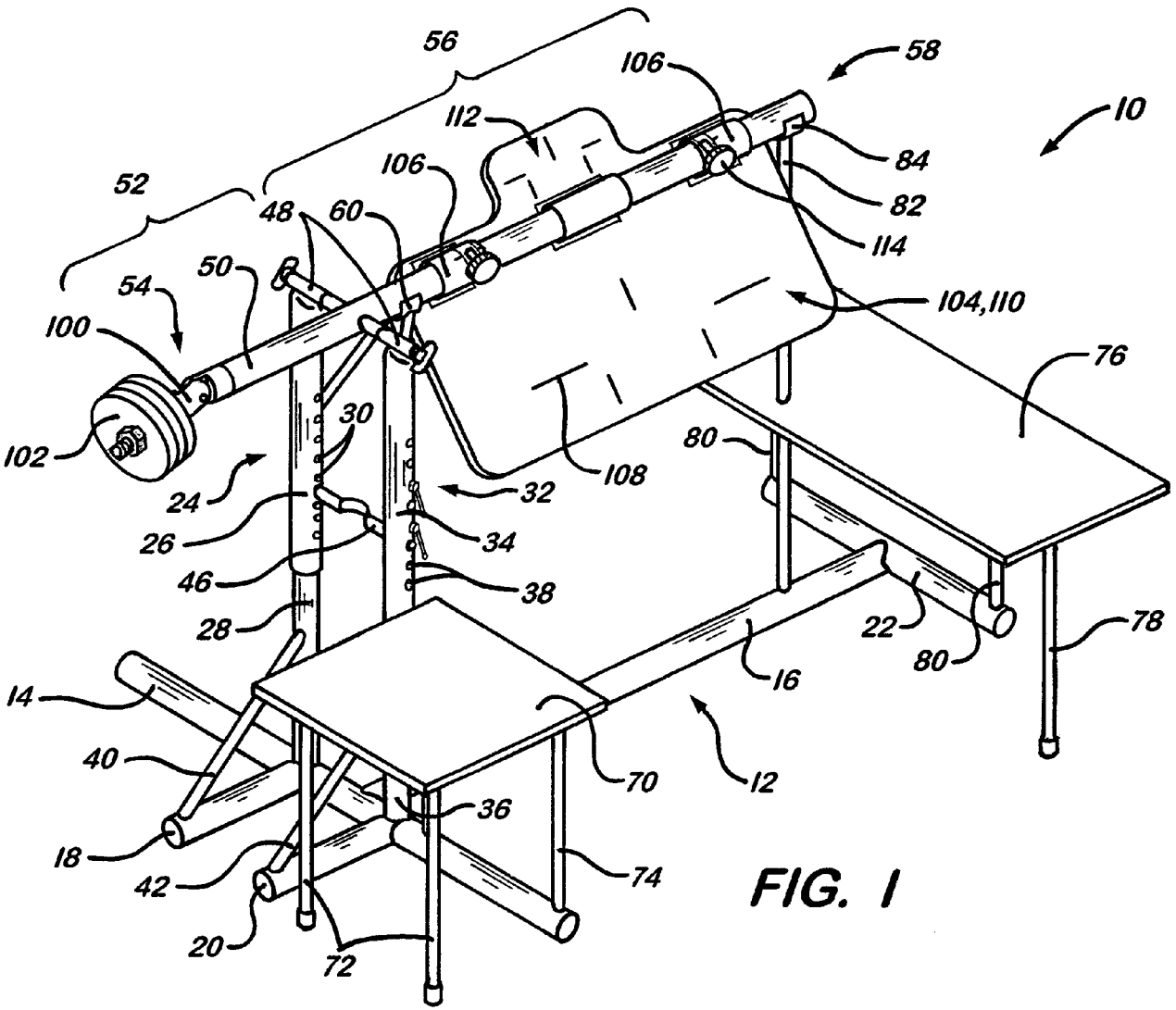
FIG. 1 shows a perspective view of a work station of the invention.

Still referring to FIG. 1, cradle stand 82 extends vertically from cross member 16 proximate said second stabilizing member 22. Cradle stand 82 has an arm receiving member 84 on an upper end thereof. Arm receiving member 84 is provided for receiving second end 58 of support arm 50. Cradle stand 82 is preferably adjustable to allow for setting support arm 50 at a desired height, which preferably corresponds to height adjustments of risers 24 and 32.

A pivotal counter weight receiving member 100 is pivotally affixed to first end 54 of support arm 50. A selected amount of weight 102 may be affixed to counter weight receiving member 100 for counterbalancing support arm 50. By selecting an appropriate amount of weight 102 a perfect balance of support arm 50 may be achieved about pivot member 48 for fingertip positioning of support arm 50 whether support arm 50 is unloaded or fully loaded.

A table 104 is rotationally affixed to second section 56 of support arm 50. Table 104 is preferably secured to support arm 50 by a plurality of hinge members 106. Table 104 preferably defines a plurality of retaining members 108. Examples of retaining members 108 include grooves for receiving threaded securement devices, protuberances for engaging an item, receptacles for receiving protuberances from an item, slots for receiving protuberances from an item, hooks for grasping an item, or other suitable retaining features. Examples of items that may be retained on table 104 include keyboard or laptop computer 109*a* (FIG. 2), mouse 109*b* (FIG. 2), and monitor 109*c* (FIGS. 2–5). Table 104 preferably has a work area 110 on a first side of support arm 50 and a monitor area 112 on a second side of support arm 50. Locking members 114 are preferably provided on selected hinge members 106 for securing table 104 in a desired rotational orientation with respect to support arm 50. Locking members may be worm gears that function to set table 104 at a desired orientation.

A human support device 120 (FIGS. 5 and 6) is positioned over cross member 16 such that a human is supported by human support device 120 in a position suitable for easily accessing computer components that may be affixed to table 104. Preferably, support arm 50 is adjusted at an appropriate height and table 104 is rotationally positioned such that a user may support his or her elbows on human support device 120 and have easy access to laptop computer/keyboard 109*b* secured on table 104. Additionally, work station 10 and/or human support device 120 is positioned such that the eyes of the user are positioned directly in front of monitor 109*c* in an ergonomically desirable orientation.

Figure 11:
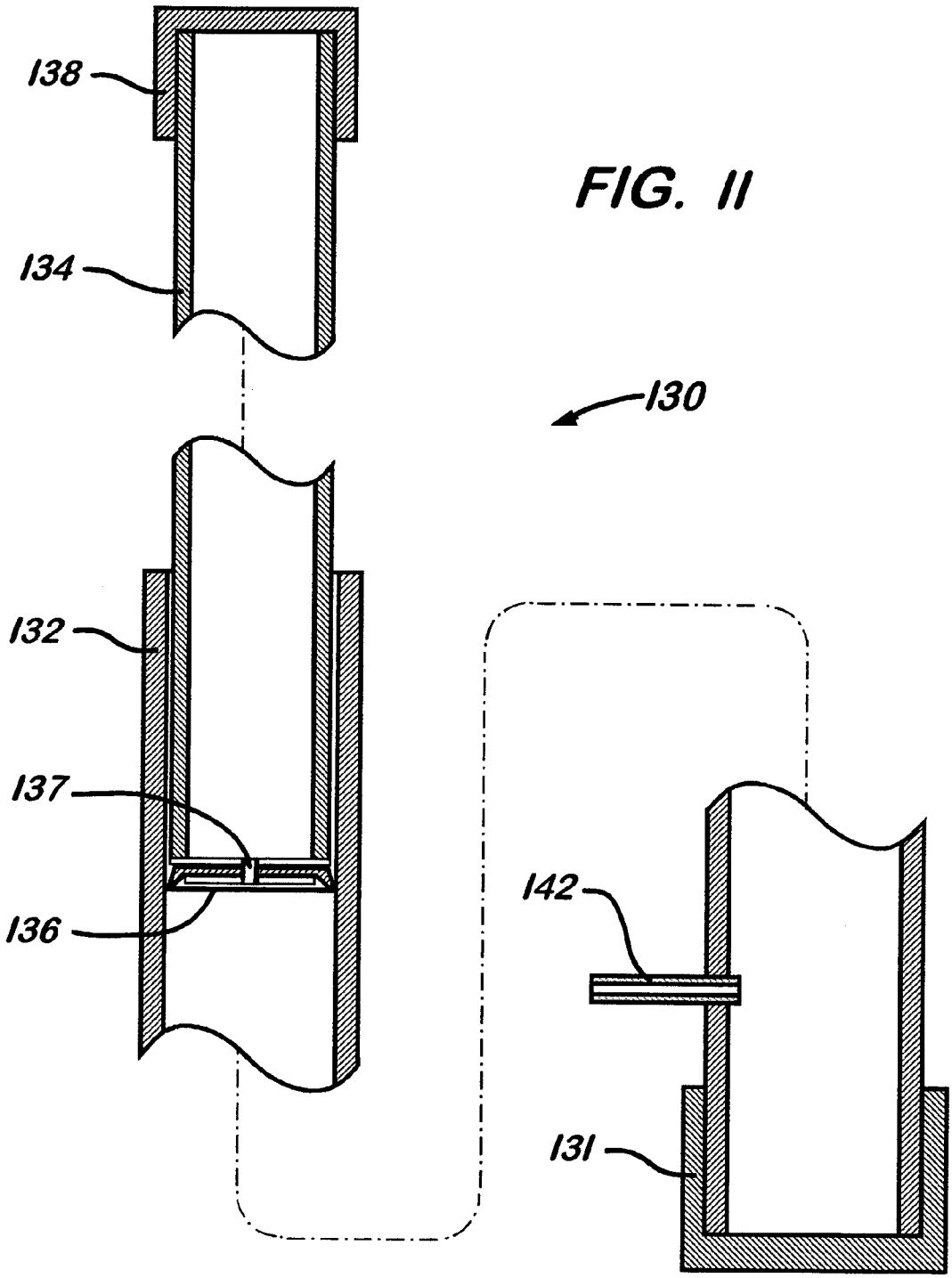
FIG. 11 is a cross-sectional view of the pneumatic lift cylinder of FIG. 10.

To assist in positioning work station 10, a pneumatic cylinder 130 (FIGS. 10, 11) may be located within one or both of risers 24 and 32. Pneumatic cylinder 130 is preferably constructed of a base tube 132 and a sliding tube 134. An air tight seal is formed between base tube 132 and sliding tube 134 with seal 136 (FIG. 11). A metering orifice 137 is provided to equalize pressure between base tube 132 and sliding tube 134 to provide shock absorbing action within risers 24 and 32. A top cap 138 seals the top of sliding tube 134 and a bottom cap 131 seals the bottom of the base tube 132. A top filler 140 (FIG. 10) preferably provides top cap 138 a flat area to apply lifting force equally within the conical neck between top cap 138 and pivot member 48 of risers 24 and 32. A stem 142 preferably protrudes from sliding tube 132 for receiving air from a compressed air source (not shown).

Figure 2:
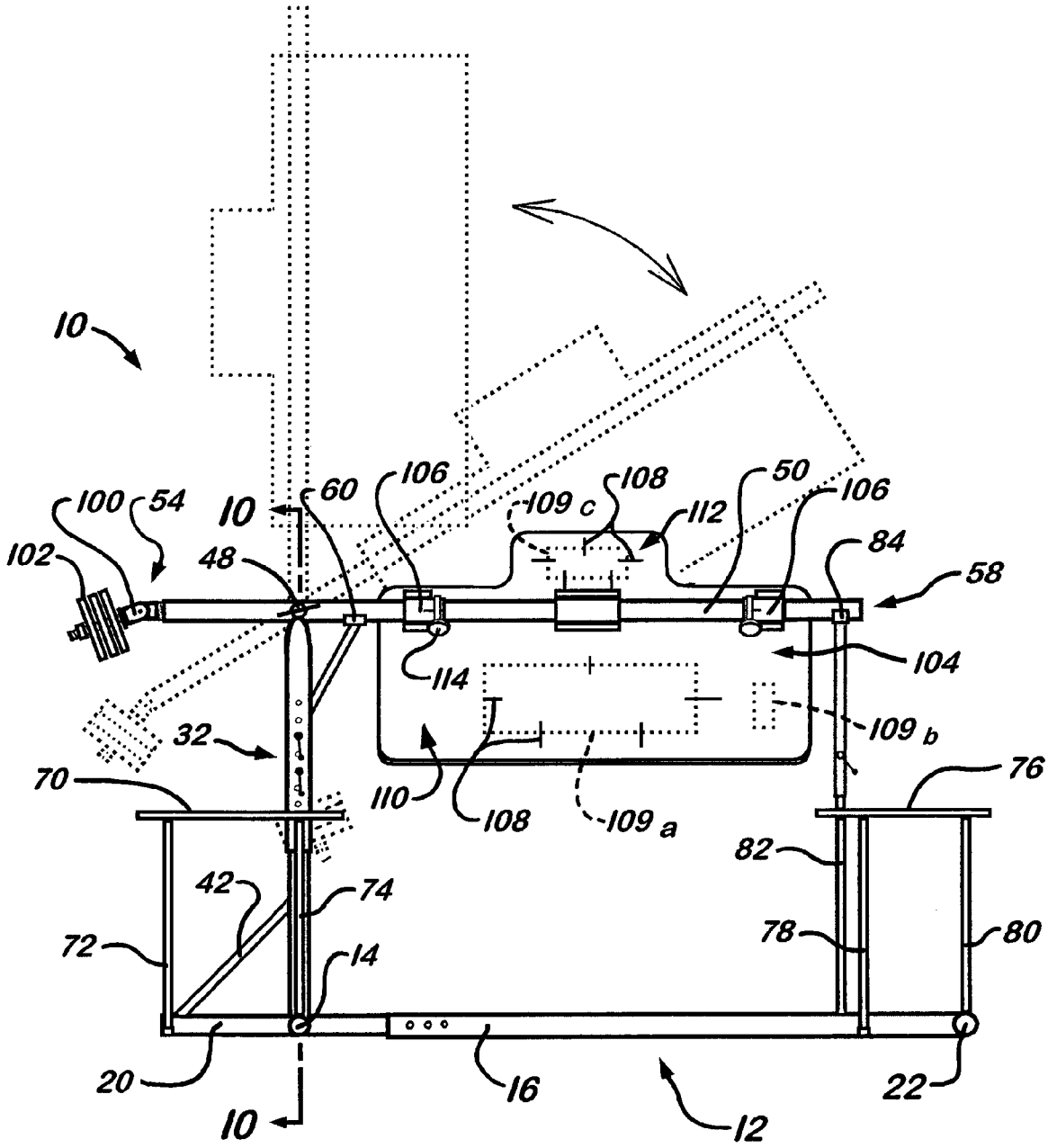
FIG. 2 shows an elevation view of the work station of the invention wherein the pivot member and table assembly is shown in a raised and partially raised position in phantom lines.
Figure 3:
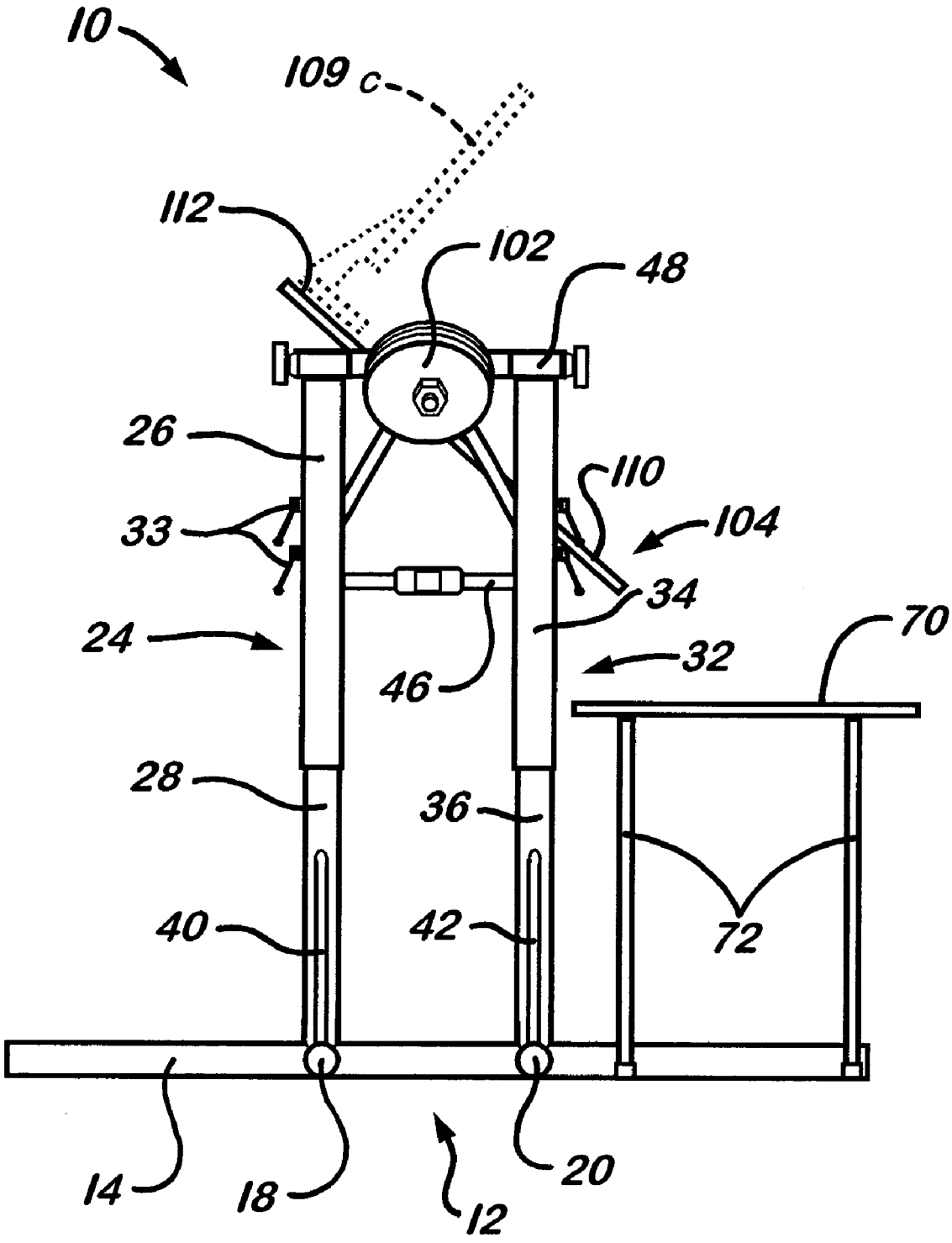
FIG. 3 is a side elevation view of the work station of FIG. 1 wherein a computer monitor is shown positioned on the table in phantom lines.
Figure 4:
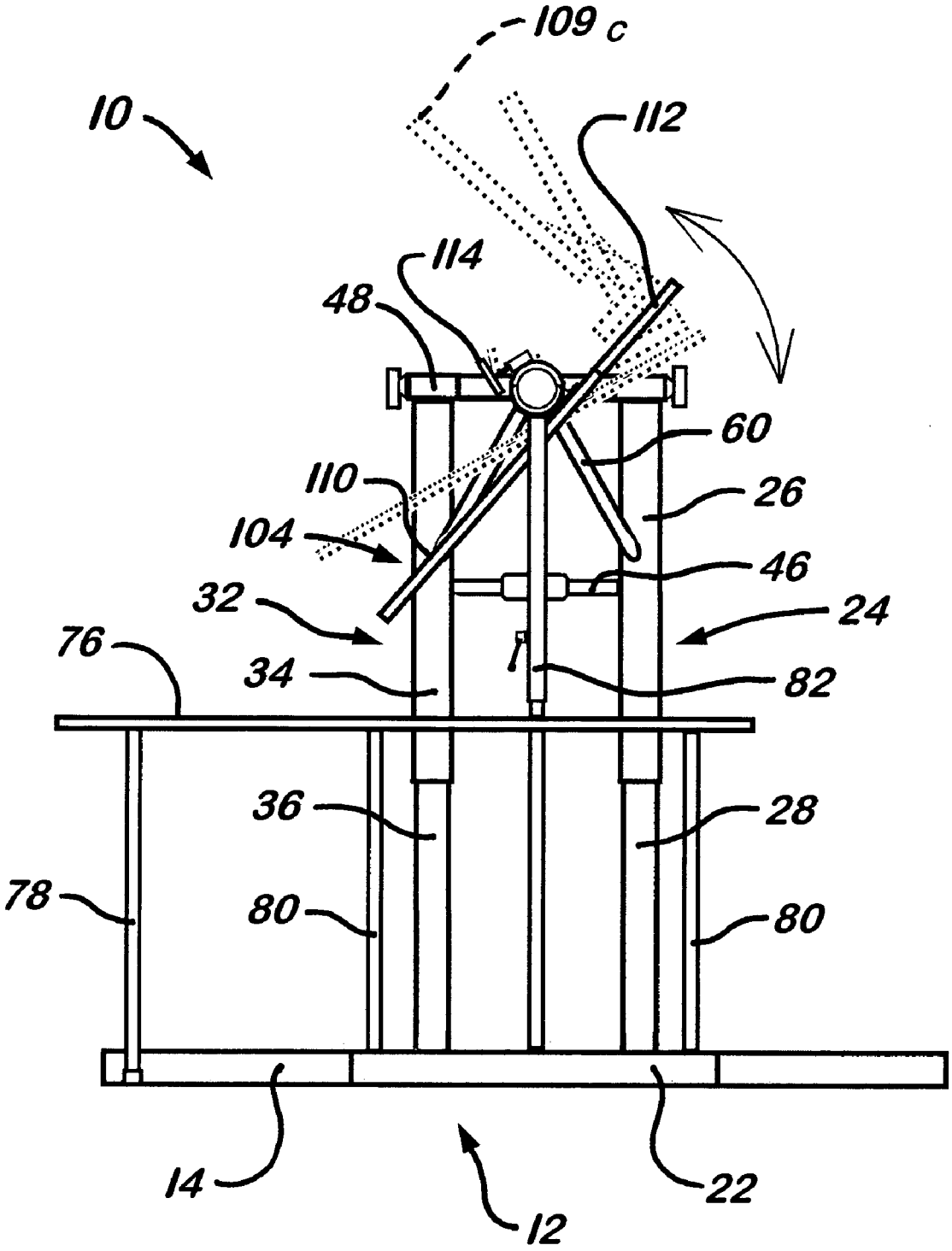
FIG. 4 is a side elevation view of the work station of FIG. 1 wherein the table is shown in several positions with phantom lines.

In use, workstation 10 of the invention is preferably configured such that support arm 50 may be positioned in an upright orientation as shown in FIG. 2 with phantom lines. When support arm 50 is set in an upright position, a user may easily access a human support device 120 such as a reclining chair shown in FIG. 5 or a mattress shown in FIG. 6. Once a user has positioned himself or herself in a desired position on human support device 120, a user may pivot the support arm 50 about pivot member 48 to easily position the table 104 in front of the user. To assist in manipulating support arm 50, weights 102 are preferably mounted on counterweight receiving member 100 in an amount that perfectly balances the weight of table 104 and computer components affixed thereto, such as, laptop/keyboard 109*a*, mouse 109*b*, and monitor 109*c*. The computer components are preferably removably affixed to the table 104 such that the components do not inadvertently move when the support arm 50 is positioned in the upright position. If an appropriate amount of weight 102 has been affixed to the counterweight retaining member 100 then only fingertip pressure is required to manipulate the support arm 50 from an upright position to a horizontal or work position. Therefore, the workstation 10 of the invention is ideally suited for use by individuals having physical limitations such as back injury or other limitations.

When support arm 50 is in a horizontal position, the support arm 50 and table 104 is supported by a first pivot member cradle 60 as shown in FIG. 2. Alternatively, pivot arm 50 may be supported by support arm sleeve 62 shown in FIGS. 6 and 7. Support arm sleeve 62 works in conjunction with first inverted segment 64 and second segment 67 each of which functions to maintain the support arm 50 in a stable horizontal configuration. Additionally, a cradle stand 82 with cradle member 84 may be provided to support second end 58 of pivot arm 50. To ensure optimum positioning, the table 104 may be rotationally adjusted about support arm 50 via hinge members 106. Locking members 114 are utilized to affix table 104 in a preferred rotational orientation with respect to support arm 50. Ideally, computer monitor 109*c* is located in an ergonomic relationship with respect to the eyes of a user. For example, some people advocate that a monitor, such as monitor 109*c*, should squarely address a user and that the monitor screen should be positioned approximately arms' length away from and slightly below the forward field of vision of the user. Preferably, a user should be able to support his or her elbows on the human support device 120 and be able to access laptop computer/keyboard 109*a* on work area 110 of table 104.

When a user desires to discontinue work on the work station 10, the user may apply light pressure to a support arm 50 and pivot the table surface 104 upwards until support arm 50 is in a vertical or upright configuration. Counterweight member 100 is offset slightly from a longitudinal access of the support arm 50. As a result, when the support arm 50 is in an upright configuration, the pivot arm is weight biased to maintain balance through the full range of travel, i.e., the offset of counterweight member 100 functions to counterbalance items 109*a*, 109*b* and 109*c*, when support arm 50 is in a vertical orientation. Travel beyond an upright position is restricted by the cross support member 46 visible in FIGS. 3 and 5.

As a further assistance to a user in adjusting a height of the table 104, one or more of risers 24 and 32 may be provided with a pneumatic cylinder 130 located therein. The pneumatic cylinder 130 functions to easily adjust the height of risers 24, 32. Compressed air or other compressed fluid that may be provided by an electrical compressor or other means to drive pneumatic cylinder 130 to a desired position.

Depending upon the desired configuration, the workstation 10 may be comprised of components on a first side of human support device 120 and a second side of human support device 120 as shown in FIG. 2. Alternatively, it may be desirable to maintain or to locate components of workstation 10 on a single side of human support device 120 as shown in FIG. 6.

In summary, the work station of the invention provides an ergonomically positionable structure that allows for a user to easily access computer equipment such as a keyboard and monitor while in a substantially horizontal or reclined position. The work station of the device is therefor ideal for individuals who experience back pain and for whom maintaining a seated position for extended periods of time is painful or impossible. An additional advantage of the workstation of the invention is that when properly configured, weights located on counterweight receiving member counterbalance support arm 50 about pivot member 48 such that support arm 50 may be easily pivoted from a horizontal position to a vertical position. Ideally, support arm 50 may be moved with only fingertip pressure. The ability to move support arm 50 from a vertical to horizontal position with minimal effort is desirable for individuals who are plagued with back pain. A further advantage of the invention is that support arm 50 may be pivoted upwards to a vertical position. The vertical position allows completely open access to the human support device whether the human support device is a reclining chair, a bed or other type of support device. Therefore, a user benefits from unobstructed ingress to and egress from the human support device.

A further advantage of the invention is that the support arm 50 is maintained in a vertical position by offsetting weights 102 from vertical when the support arm 50 is in a vertical position. By displacing the weights 102 from the vertical axis of support arm 50, the support arm 50 is maintained in a balanced state, even when support arm 50 is in a vertical orientation, thereby preventing inadvertent movement of support arm 50.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A work station comprising:

a base;

a riser extending upwardly from said base;

a support arm connected to said riser at a vertical pivot, said support arm having a first section on a first side of said riser and a second section on a second side of said riser;

a table affixed to said second section of said support arm;

a counter weight affixed to said first section of said support arm wherein said counter weight is offset from a longitudinal axis of said support arm;

wherein said counter weight is affixed to a vertically adjustable mount that facilitates a degree of said offset to at least partially counterbalance a weight of selected items that are affixed on said second section of said support arm throughout a full range of motion from a horizontal work position to a vertical second position to allow for said support arm to be easily pivoted from said horizontal work position to said vertical second position.

2. The work station according to claim 1 wherein:

said base extends beneath a human support device from a first side to a second side of said human support device;

wherein said base is adjustable in length to accommodate different sizes of human support devices.

3. The work station according to claim 2 further comprising:

components in communication with a first end of said base; and components in communication with a second end of said base.

4. The work station according to claim 1 further comprising:

a support for engaging said second section of said support arm and for restraining said support arm in a vertical and a horizontal direction to stabilize said support arm when said support arm is in said horizontal work position.

5. The work station according to claim 4 wherein:

said support is height adjustable.

6. The work station according to claim 1 further comprising:

a support affixed to said riser for stabilizing said support arm when said support arm is in said work position.

7. The work station according to claim 1 wherein:

said riser is adapted to be adjustable with respect to height.

8. The work station according to claim 1 wherein:

said table is pivotally mounted on said support arm.

9. The work station according to claim 1 wherein:

said table defines a plurality of retaining members for affixing selected computer components to said table.

10. The work station according to claim 1 wherein:

said second position of said support arm allows for a user to have unobstructed ingress to and egress from a human support device.

11. The work station according to claim 1 wherein:

said counter weight is pivotally affixed to said first section of said support arm.

12. The work station according to claim 2 wherein:

said base is adjustable to accommodate different widths of said human support device.

13. The work station according to claim 1 wherein:

said vertically adjustable mount comprises a pivotal connection, wherein a receiving member that holds said counter weight is pivotally connected to said first section of said support arm at said pivotal connection.

14. A method of facilitating ease of ingress to and egress from a work station comprising the steps of:

providing a pivotally supported support arm having a first section on a first side of a pivot and a second section on a second side of a pivot;

affixing selected items to a work area affixed to said second section of said support arm;

affixing a counter weight on an adjustable mount to said first section of said support arm to substantially balance said support arm about said pivot;

adjusting an orientation of said adjustable mount with respect to said second section of said support arm to counterbalance a weight of said selected items when said support arm is positioned from a horizontal work position to a vertical orientation, thereby enabling said support arm to be vertically pivoted to a desired location with minimal effort.

15. A work station comprising:

a base;

a riser extending upwardly from said base;

a support arm connected to said riser at a vertical pivot, said support arm having a first section on a first side of said riser and a second section on a second side of said riser;

a table affixed to said second section of said support arm;

a receiving member attached to said first section on a vertically adjustable mount;

a counter weight affixed to said receiving member of said support arm wherein said counter weight is offset from a longitudinal axis of said support arm;

wherein said offset of said counterweight is adjustable so that said offset counterbalances a weight of selected items that are affixed on said second section of said support arm to allow for said support arm to be easily pivoted from a horizontal work position to a vertical position; and wherein said vertically adjustable mount comprises a pivotal connection.

* * * * *